US008454096B2

(12) United States Patent
Hall et al.

(10) Patent No.: US 8,454,096 B2
(45) Date of Patent: Jun. 4, 2013

(54) HIGH-IMPACT RESISTANT TOOL

(75) Inventors: David R. Hall, Provo, UT (US); Ronald B. Crockett, Payson, UT (US); Jeff Jepson, Spanish Fork, UT (US)

(73) Assignee: Schlumberger Technology Corporation, Houston, TX (US)

( * ) Notice: Subject to any disclaimer, the term of this patent is extended or adjusted under 35 U.S.C. 154(b) by 666 days.

(21) Appl. No.: 12/146,665

(22) Filed: Jun. 26, 2008

(65) Prior Publication Data

US 2008/0258536 A1 Oct. 23, 2008

Related U.S. Application Data

(63) Continuation of application No. 12/135,595, filed on Jun. 9, 2008, now Pat. No. 7,946,656, which is a continuation of application No. 12/112,743, filed on Apr. 30, 2008, now Pat. No. 8,029,068, which is a continuation-in-part of application No. 12/051,738, filed on Mar. 19, 2008, now Pat. No. 7,669,674, which is a continuation-in-part of application No. 12/051,689, filed on Mar. 19, 2008, now Pat. No. 7,963,617, which is a continuation of application No. 12/051,586, filed on Mar. 19, 2008, now Pat. No. 8,007,050, which is a continuation-in-part of application No. 12/021,051, filed on Jan. 28, 2008, now Pat. No. 8,123,302, which is a continuation-in-part of application No. 12/021,019, filed on Jan. 28, 2008, which is a continuation-in-part of application No. 11/971,965, filed on Jan. 10, 2008, now Pat. No. 7,648,210, which is a continuation of application No. 11/947,644, filed on Nov. 29, 2007, now Pat. No. 8,007,051, which is a continuation-in-part of application No. 11/844,586, filed on Aug. 24, 2007, now Pat. No. 7,600,823, which is a continuation-in-part of application No.

(Continued)

(51) Int. Cl.
*E21C 35/19* (2006.01)

(52) U.S. Cl.
USPC ..... 299/113; 299/105

(58) Field of Classification Search
USPC ..... 299/79.1, 81.1–81.3, 111, 113, 105, 299/107
See application file for complete search history.

(56) References Cited

U.S. PATENT DOCUMENTS

| | | | |
|---|---|---|---|
| 1,899,343 | A | 2/1933 | Mackey |
| 2,004,315 | A | 6/1935 | Fean |

(Continued)

FOREIGN PATENT DOCUMENTS

| | | |
|---|---|---|
| DE | 3307910 | 9/1984 |
| DE | 3431495 | 3/1986 |

(Continued)

OTHER PUBLICATIONS

Hoch, G. Jeffrey, "Is There Room for Geothermal Energy," Innovation: America's Journal of Tech Communication, http://www.innovation-america.org/ (Dec. 2006-Jan. 2007).

(Continued)

*Primary Examiner* — John Kreck
(74) *Attorney, Agent, or Firm* — Brinks Hofer Gilson & Lione

(57) ABSTRACT

A high impact resistant tool comprises a steel shank. The steel shank has a hollow portion, and first and second ends. The shank is adapted for insertion into a holder and connection to a driving mechanism. A carbide cap is joined at a brazed joint to the first end of the shank.

20 Claims, 13 Drawing Sheets

Related U.S. Application Data

11/829,761, filed on Jul. 27, 2007, now Pat. No. 7,722,127, which is a continuation-in-part of application No. 11/773,271, filed on Jul. 3, 2007, now Pat. No. 7,997,661, which is a continuation-in-part of application No. 11/766,903, filed on Jun. 22, 2007, which is a continuation of application No. 11/766,865, filed on Jun. 22, 2007, which is a continuation-in-part of application No. 11/742,304, filed on Apr. 30, 2007, now Pat. No. 7,475,948, which is a continuation of application No. 11/742,261, filed on Apr. 30, 2007, now Pat. No. 7,469,971, which is a continuation-in-part of application No. 11/464,008, filed on Aug. 11, 2006, now Pat. No. 7,338,135, which is a continuation-in-part of application No. 11/463,998, filed on Aug. 11, 2006, now Pat. No. 7,384,105, which is a continuation-in-part of application No. 11/463,990, filed on Aug. 11, 2006, now Pat. No. 7,320,505, which is a continuation-in-part of application No. 11/463,975, filed on Aug. 11, 2006, now Pat. No. 7,445,294, which is a continuation-in-part of application No. 11/463,962, filed on Aug. 11, 2006, now Pat. No. 7,413,256, which is a continuation-in-part of application No. 11/463,953, filed on Aug. 11, 2006, now Pat. No. 7,464,993, application No. 12/146,665, which is a continuation-in-part of application No. 11/695,672, filed on Apr. 3, 2007, now Pat. No. 7,396,086, which is a continuation-in-part of application No. 11/686,831, filed on Mar. 15, 2007, now Pat. No. 7,568,770.

(56) References Cited

U.S. PATENT DOCUMENTS

| | | | | | |
|---|---|---|---|---|---|
| 2,124,438 | A | | 7/1938 | Struk et al. | |
| 2,247,499 | A | | 7/1941 | Hutchison, Jr. | |
| 2,255,650 | A | | 9/1941 | Burke | |
| 2,720,392 | A | | 10/1955 | Cartlidge | |
| 2,972,713 | A | | 6/1958 | Sutton, Jr. | |
| 3,089,215 | A | | 5/1963 | Stubbs | |
| 3,254,392 | A | | 6/1966 | Novkov | |
| 3,268,259 | A | * | 8/1966 | Snipe | 299/111 |
| 3,342,531 | A | | 9/1967 | Krekeler | |
| 3,342,532 | A | | 9/1967 | Krekeler | |
| 3,397,012 | A | | 8/1968 | Krekeler | |
| 3,397,013 | A | | 8/1968 | Krekeler | |
| 3,429,617 | A | | 2/1969 | Lauber | |
| 3,498,677 | A | | 3/1970 | Morrow | |
| 3,512,838 | A | | 5/1970 | Kniff | |
| 3,627,381 | A | | 12/1971 | Krekeler | |
| 3,650,565 | A | | 3/1972 | Kniff | |
| 3,655,244 | A | | 4/1972 | Swisher | |
| 3,746,396 | A | | 7/1973 | Radd | |
| 3,767,266 | A | | 10/1973 | Krekeler | |
| 3,778,112 | A | | 12/1973 | Krekeler | |
| 3,807,804 | A | | 4/1974 | Kniff | |
| 3,820,848 | A | | 6/1974 | Kniff | |
| 3,821,993 | A | | 7/1974 | Kniff et al. | |
| 3,830,321 | A | * | 8/1974 | McKenry et al. | 175/332 |
| 3,833,265 | A | | 9/1974 | Elders | |
| 3,865,437 | A | | 2/1975 | Crosby | |
| 3,929,054 | A | | 12/1975 | Gutshall | |
| 3,932,952 | A | | 1/1976 | Helton et al. | |
| 3,942,838 | A | | 3/1976 | Bailey et al. | |
| 3,945,681 | A | | 3/1976 | White | |
| 3,955,635 | A | | 5/1976 | Skidmore | |
| 3,957,307 | A | | 5/1976 | Varda | |
| 4,005,914 | A | | 2/1977 | Newman | |
| 4,006,936 | A | | 2/1977 | Crabiel | |
| 4,084,856 | A | | 4/1978 | Emmerich et al. | |
| 4,096,917 | A | | 6/1978 | Harris | |
| 4,098,362 | A | | 7/1978 | Bonnice | |
| 4,109,737 | A | | 8/1978 | Bovenkerk | |
| RE29,900 | E | | 2/1979 | Kniff | |
| 4,149,753 | A | | 4/1979 | Stoltz et al. | |
| 4,156,329 | A | | 5/1979 | Daniels | |
| 4,176,723 | A | | 12/1979 | Arceneaux | |
| 4,199,035 | A | | 4/1980 | Thompson | |
| 4,201,421 | A | | 5/1980 | Den Besten | |
| 4,247,150 | A | | 1/1981 | Wrulich et al. | |
| 4,251,109 | A | | 2/1981 | Roepke | |
| 4,253,533 | A | | 3/1981 | Baker, III | |
| 4,268,089 | A | | 5/1981 | Spence | |
| 4,277,106 | A | | 7/1981 | Sahley | |
| 4,280,573 | A | | 7/1981 | Sudnishnikov et al. | |
| 4,289,211 | A | | 9/1981 | Lumen | |
| 4,304,312 | A | | 12/1981 | Larsson | |
| 4,337,980 | A | | 7/1982 | Krekeler | |
| 4,397,361 | A | | 8/1983 | Langford, Jr. | |
| 4,397,362 | A | | 8/1983 | Dice et al. | |
| 4,439,250 | A | | 3/1984 | Acharya et al. | |
| 4,443,038 | A | * | 4/1984 | Brown | 299/81.1 |
| 4,445,580 | A | | 5/1984 | Sahley | |
| 4,453,775 | A | | 6/1984 | Clemmow | |
| 4,465,221 | A | | 8/1984 | Schmidt | |
| 4,484,644 | A | | 11/1984 | Cook | |
| 4,484,783 | A | | 11/1984 | Emmerich | |
| 4,489,986 | A | | 12/1984 | Dziak | |
| 4,497,520 | A | | 2/1985 | Ojanen | |
| 4,499,795 | A | | 2/1985 | Radtke | |
| 4,535,853 | A | | 8/1985 | Ippolito et al. | |
| 4,537,448 | A | | 8/1985 | Ketterer | |
| 4,538,691 | A | | 9/1985 | Dennis | |
| 4,542,942 | A | | 9/1985 | Zitz et al. | |
| 4,574,895 | A | | 3/1986 | Dolezal et al. | |
| 4,579,491 | A | | 4/1986 | Kull | |
| 4,583,786 | A | | 4/1986 | Thorpe et al. | |
| 4,627,665 | A | | 12/1986 | Ewing | |
| 4,640,374 | A | | 2/1987 | Dennis | |
| 4,647,111 | A | | 3/1987 | Bronder et al. | |
| 4,657,308 | A | | 4/1987 | Clapham | |
| 4,660,890 | A | | 4/1987 | Mills | |
| 4,669,786 | A | | 6/1987 | Morgan et al. | |
| 4,678,237 | A | | 7/1987 | Collin | |
| 4,682,987 | A | | 7/1987 | Brady et al. | |
| 4,684,176 | A | | 8/1987 | Den Besten | |
| 4,688,856 | A | | 8/1987 | Elfgen | |
| 4,694,918 | A | | 9/1987 | Hall | |
| 4,702,525 | A | | 10/1987 | Sollami | |
| 4,720,199 | A | | 1/1988 | Geczy et al. | |
| 4,725,098 | A | | 2/1988 | Beach | |
| 4,728,153 | A | | 3/1988 | Ojanen | |
| 4,729,603 | A | | 3/1988 | Elfgen | |
| 4,736,533 | A | | 4/1988 | May et al. | |
| 4,746,379 | A | | 5/1988 | Rabinkin | |
| 4,765,686 | A | * | 8/1988 | Adams | 299/81.1 |
| 4,765,687 | A | * | 8/1988 | Parrott | 299/81.1 |
| 4,776,862 | A | | 10/1988 | Wiand | |
| 4,804,231 | A | | 2/1989 | Buljan et al. | |
| 4,811,801 | A | | 3/1989 | Salesky et al. | |
| 4,836,614 | A | | 6/1989 | Ojanen | |
| 4,850,649 | A | | 7/1989 | Beach et al. | |
| 4,852,672 | A | | 8/1989 | Behrens | |
| 4,880,154 | A | | 11/1989 | Tank | |
| 4,880,247 | A | | 11/1989 | Herridge | |
| 4,889,017 | A | | 12/1989 | Fuller et al. | |
| 4,893,875 | A | | 1/1990 | Lonn | |
| 4,911,503 | A | | 3/1990 | Stiffler et al. | |
| 4,911,504 | A | | 3/1990 | Stiffler et al. | |
| 4,921,310 | A | | 5/1990 | Hedlund et al. | |
| D308,683 | S | | 6/1990 | Meyers | |
| 4,932,723 | A | | 6/1990 | Mills | |
| 4,934,467 | A | | 6/1990 | Langford, Jr. | |
| 4,940,288 | A | | 7/1990 | Stiffler | |
| 4,941,711 | A | | 7/1990 | Stiffler | |
| 4,944,559 | A | | 7/1990 | Sionnet | |
| 4,951,762 | A | | 8/1990 | Lundell | |
| 4,956,238 | A | | 9/1990 | Griffin | |
| RE33,494 | E | | 12/1990 | Hindmarsh et al. | |
| 4,981,184 | A | | 1/1991 | Knowlton et al. | |
| 4,981,328 | A | | 1/1991 | Stiffler et al. | |
| 5,007,685 | A | | 4/1991 | Beach | |
| 5,011,515 | A | | 4/1991 | Frushour | |
| 5,018,793 | A | | 5/1991 | Den Besten | |
| 5,027,914 | A | | 7/1991 | Wilson | |

5,054,217 A 10/1991 Nilsson et al.
5,074,623 A 12/1991 Hedlund et al.
5,088,797 A 2/1992 O'Neill
5,106,166 A 4/1992 O'Neill
5,112,165 A 5/1992 Hedlund
5,119,714 A 6/1992 Scott
5,119,892 A 6/1992 Clegg et al.
5,141,289 A 8/1992 Stiffler
5,154,245 A 10/1992 Waldenstrom et al.
5,186,268 A 2/1993 Clegg
5,186,892 A 2/1993 Pope
5,222,566 A 6/1993 Taylor et al.
5,251,964 A 10/1993 Ojanen
5,255,749 A 10/1993 Bumpurs et al.
5,261,499 A 11/1993 Grubb
5,265,682 A 11/1993 Russell et al.
D342,268 S 12/1993 Meyer
5,303,984 A 4/1994 Ojanen
5,311,654 A 5/1994 Cook
5,332,051 A 7/1994 Knowlton
5,332,348 A 7/1994 Lemelson
5,333,938 A 8/1994 Gale
5,374,111 A 12/1994 Den Besten
5,410,303 A 4/1995 Comeau et al.
5,415,462 A 5/1995 Massa
5,417,475 A 5/1995 Graham et al.
5,423,389 A 6/1995 Warren et al.
5,447,208 A 9/1995 Lund
5,494,477 A 2/1996 Flood et al.
5,503,463 A 4/1996 Ojanen
5,535,839 A 7/1996 Brady
5,542,993 A 8/1996 Rabinkin
5,653,300 A 8/1997 Lund
5,655,614 A 8/1997 Azar
5,662,720 A 9/1997 O'Tighearnaigh
5,702,160 A 12/1997 Levankovskii et al.
5,713,412 A 2/1998 Wepfer et al.
5,720,528 A 2/1998 Ritchey
5,725,283 A 3/1998 O'Neill
5,730,502 A 3/1998 Montgomery, Jr.
5,732,784 A 3/1998 Nelson
5,738,415 A 4/1998 Parrott
5,738,698 A 4/1998 Kapoor et al.
5,794,728 A 8/1998 Palmberg
5,823,632 A 10/1998 Burkett
5,837,071 A 11/1998 Andersson et al.
5,845,547 A 12/1998 Sollami
5,875,862 A 3/1999 Jurewicz
5,884,979 A 3/1999 Latham
5,890,552 A 4/1999 Scott et al.
5,934,542 A 8/1999 Nakamura et al.
5,935,718 A 8/1999 Demo et al.
5,944,129 A 8/1999 Jensen
5,947,215 A 9/1999 Lundell
5,950,743 A 9/1999 Cox
5,957,223 A 9/1999 Doster et al.
5,967,250 A 10/1999 Lund et al.
5,992,405 A 11/1999 Sollami
6,000,483 A 12/1999 Jurewicz et al.
6,006,846 A 12/1999 Tibbitts
6,019,434 A 2/2000 Emmerich
6,044,920 A 4/2000 Massa et al.
6,051,079 A 4/2000 Andersson et al.
6,056,911 A 5/2000 Griffin
6,065,552 A 5/2000 Scott et al.
6,086,160 A 7/2000 Bitelli
6,099,081 A 8/2000 Warren et al.
6,109,377 A 8/2000 Massa et al.
6,113,195 A 9/2000 Mercier et al.
6,131,675 A 10/2000 Anderson
6,170,917 B1 1/2001 Heinrich et al.
6,193,770 B1 2/2001 Sung
6,196,636 B1 3/2001 Mills et al.
6,196,910 B1 3/2001 Johnson
6,199,645 B1 3/2001 Anderson et al.
6,199,956 B1 3/2001 Kammerer
6,213,226 B1 4/2001 Eppink et al.
6,216,805 B1 4/2001 Lays
6,223,824 B1 5/2001 Moyes
6,241,035 B1 6/2001 Portwood
6,269,893 B1 8/2001 Beaton et al.
6,270,165 B1 8/2001 Peay
6,340,064 B2 1/2002 Fielder et al.
6,341,823 B1 1/2002 Sollami
6,354,771 B1 3/2002 Bauschulte et al.
6,357,832 B1 3/2002 Sollami
6,364,034 B1 4/2002 Schoeffler
6,364,420 B1 4/2002 Sollami
6,371,567 B1 4/2002 Sollami
6,375,272 B1 4/2002 Ojanen
6,394,200 B1 5/2002 Watson et al.
6,412,163 B1 7/2002 Russell
6,419,278 B1 7/2002 Cunningham
6,460,637 B1 10/2002 Siracki et al.
6,474,425 B1 11/2002 Truax et al.
6,478,383 B1 11/2002 Ojanen
6,481,803 B2 11/2002 Ritchey
6,499,547 B2 12/2002 Scott
6,508,516 B1 1/2003 Kammerer
6,510,906 B1 1/2003 Richert et al.
6,513,606 B1 2/2003 Krueger
6,517,902 B2 2/2003 Drake et al.
6,554,369 B2 4/2003 Sollami
RE38,151 E 6/2003 Penkunas et al.
6,585,326 B2 7/2003 Sollami
6,585,327 B2 7/2003 Sollami
6,594,881 B2 7/2003 Tibbitts
6,601,662 B2 8/2003 Matthias et al.
6,622,803 B2 9/2003 Harvey
6,644,755 B1 11/2003 Kammerer
6,651,758 B2 11/2003 Xiang et al.
6,659,206 B2 12/2003 Liang et al.
6,672,406 B2 1/2004 Beuershausen
6,685,273 B1 2/2004 Sollami
6,692,083 B2 2/2004 Latham
6,702,393 B2 3/2004 Mercier
6,709,065 B2 3/2004 Peay et al.
6,719,074 B2 4/2004 Tsuda et al.
6,729,420 B2 5/2004 Mensa-Wilmot
6,732,914 B2 5/2004 Cadden et al.
6,733,087 B2 5/2004 Hall et al.
6,739,327 B2 5/2004 Sollami
6,758,530 B2 7/2004 Sollami
6,786,557 B2 9/2004 Montgomery, Jr.
6,822,579 B2 11/2004 Goswami et al.
6,824,225 B2 11/2004 Stiffler
6,846,045 B2 1/2005 Sollami
6,851,758 B2 2/2005 Beach
6,854,810 B2 2/2005 Montgomery, Jr.
6,861,137 B2 3/2005 Griffin
6,863,352 B2 3/2005 Sollami
6,880,744 B2 4/2005 Noro et al.
6,889,890 B2 5/2005 Yamazaki
6,938,961 B2 9/2005 Broom
6,962,395 B2 11/2005 Mouthaan
6,966,611 B1 11/2005 Sollami
6,994,404 B1 2/2006 Sollami
7,094,473 B2 8/2006 Takayama et al.
7,097,258 B2 8/2006 Sollami
7,097,473 B2 8/2006 Takayama
7,118,181 B2 10/2006 Frear
7,172,256 B2 2/2007 Sleep et al.
7,204,560 B2 4/2007 Mercier et al.
7,234,782 B2 6/2007 Stehney
D560,699 S 1/2008 Omi
7,320,505 B1 1/2008 Hall et al.
7,343,947 B1 3/2008 Sollami
7,369,743 B2 5/2008 Watkins et al.
7,380,888 B2 6/2008 Ojanen
7,384,105 B2 6/2008 Hall et al.
7,387,345 B2 6/2008 Hall et al.
7,390,066 B2 6/2008 Hall et al.
7,413,258 B2 8/2008 Hall et al.
7,445,294 B2 11/2008 Hall et al.
7,464,993 B2 12/2008 Hall et al.
2001/0040053 A1 11/2001 Beuershausen
2002/0070602 A1 6/2002 Sollami
2002/0074851 A1 6/2002 Montgomery, Jr.

| | | | | |
|---|---|---|---|---|
| 2002/0153175 | A1 | 10/2002 | Ojanen | |
| 2002/0175555 | A1 | 11/2002 | Mercier | |
| 2003/0015907 | A1 | 1/2003 | Sollami | |
| 2003/0047985 | A1 | 3/2003 | Stiffler | |
| 2003/0137185 | A1 | 7/2003 | Sollami | |
| 2003/0140360 | A1 | 7/2003 | Mansuy | |
| 2003/0141350 | A1 | 7/2003 | Noro et al. | |
| 2003/0141753 | A1 | 7/2003 | Peay et al. | |
| 2003/0209366 | A1 * | 11/2003 | McAlvain | 175/427 |
| 2003/0213621 | A1 | 11/2003 | Britten | |
| 2003/0230926 | A1 | 12/2003 | Mondy | |
| 2003/0234280 | A1 | 12/2003 | Cadden | |
| 2004/0026132 | A1 | 2/2004 | Hall et al. | |
| 2004/0026983 | A1 | 2/2004 | McAlvain | |
| 2004/0065484 | A1 | 4/2004 | McAlvain | |
| 2004/0228694 | A1 | 11/2004 | Webb et al. | |
| 2004/0238221 | A1 | 12/2004 | Runia et al. | |
| 2004/0256155 | A1 | 12/2004 | Runia et al. | |
| 2005/0044987 | A1 | 3/2005 | Takayama et al. | |
| 2005/0159840 | A1 | 7/2005 | Lin | |
| 2005/0173966 | A1 | 8/2005 | Mouthaan | |
| 2006/0006727 | A1 | 1/2006 | Frear | |
| 2006/0125306 | A1 | 6/2006 | Sollami | |
| 2006/0186724 | A1 | 8/2006 | Stehney | |
| 2006/0237236 | A1 | 10/2006 | Sreshta | |
| 2006/0261663 | A1 | 11/2006 | Sollami | |
| 2007/0013224 | A1 | 1/2007 | Stehney | |
| 2008/0084106 | A1 | 4/2008 | Marathe et al. | |

FOREIGN PATENT DOCUMENTS

| | | | |
|---|---|---|---|
| DE | 3500261 | | 7/1986 |
| DE | 3818213 | | 11/1989 |
| DE | 4039217 | | 6/1992 |
| DE | 19821147 | | 11/1999 |
| DE | 10163717 | | 5/2003 |
| EP | 0295151 | | 6/1988 |
| EP | 0412287 | | 2/1991 |
| EP | 0899051 | A1 | 3/1999 |
| EP | 1186744 | | 3/2002 |
| EP | 1574309 | | 9/2005 |
| GB | 2004315 | | 3/1979 |
| GB | 2037223 | | 7/1980 |
| JP | 5280273 | | 10/1993 |
| JP | 2000052108 | A | 2/2000 |
| JP | 2002-81524 | A | 3/2002 |
| RU | 2079651 | | 5/1997 |

OTHER PUBLICATIONS

US Dept. of Energy, "Geothermal Drilling Faster & Cheaper is Better," Geothermal Today, p. 28, National Renewal Energy Laboratory Golden, Colorado (May 2000).

Glowka, David A., et al., "Progress in the Advanced Synthetic-Diamond Drill Bit Program" (1995).

Taylor, Mark A., "The State of Geothermal Technology Part 1: Subsurface Technology," pp. 29-30, Geothermal Energy Association, Washington, D.C. (Nov. 2007).

Durrand, Christopher J., "Super-hard, Thick Shaped PDC Cutters for Hard Rock Drilling: Development & Test Results," Geothermal Reservoir Engineering, Stanford, California (Feb. 3, 2010).

Jennejohn, Dan, Research & Development in Geothermal Exploration & Drilling, pp. 15, 18-19, Geothermal Energy Association, Washington, D.C. (Dec. 1, 2009).

Kennametal Inc. Catalog entitled "Construction Tools" pp. 1-20 (1997).

International Search Report for PCT/US08/69231 (Nov. 18, 2008).

Written Opinion for PCT/US08/69231 (Nov. 18, 2008).

International Preliminary Report on Patentability for PCT/US08/69231 (Jan. 5, 2010).

* cited by examiner

HIGH-IMPACT RESISTANT TOOL

CROSS REFERENCE TO RELATED APPLICATIONS

This application is a continuation of U.S. patent application Ser. No. 12/135,595 filed on Jun. 9, 2008 and is now U.S. Pat. No. 7,946,656 which is a continuation in-part of U.S. patent application Ser. No. 12/112,743 filed on Apr. 30, 2008 and is now U.S. Pat. No. 8,029,068 which is a continuation in-part of U.S. patent application Ser. No. 12/051,738 filed on Mar. 19, 2008 and is now U.S. Pat. No. 7,669,674 which is a continuation-in-part of U.S. patent application Ser. No. 12/051,689 filed on Mar. 19, 2008 and is now U.S. Pat. No. 7,963,617 which is a continuation of U.S. patent application Ser. No. 12/051,586 filed on Mar. 19, 2008 and is now U.S. Pat. No. 8,007,050 which is a continuation-in-part of U.S. patent application Ser. No. 12/021,051 filed on Jan. 28, 2008 and is now U.S. Pat. No. 8,123,302 which is a continuation-in-part of U.S. patent application Ser. No. 12/021,019 filed on Jan. 28, 2008 which is a continuation-in-part of U.S. patent application Ser. No. 11/971,965 filed on Jan. 10, 2008 and is now U.S. Pat. No. 7,648,210 which is a continuation of U.S. patent application Ser. No. 11/947,644 filed on Nov. 29, 2007and is now U.S. Pat. No. 8,007,051, which is a continuation-in-part of U.S. patent application Ser. No. 11/844,586 filed on Aug. 24, 2007 and is now U.S. Pat. No. 7,600,823. U.S. patent application Ser. No. 11/844,586 is a continuation-in-part of U.S. patent application Ser. No. 11/829,761 filed on Jul. 27, 2007 and is now U.S. Pat. No. 7,722,127. U.S. patent application Ser. No. 11/829,761 is a continuation-in-part of U.S. patent application Ser. No. 11/773,271 filed on Jul. 3, 2007 and is now U.S. Pat. No. 7,997,661. U.S. patent application Ser. No. 11/773,271 is a continuation-in-part of U.S. patent application Ser. No. 11/766,903 filed on Jun. 22, 2007. U.S. patent application Ser. No. 11/766,903 is a continuation of U.S. patent application Ser. No. 11/766,865 filed on Jun. 22, 2007. U.S. patent application Ser. No. 11/766,865 is a continuation-in-part of U.S. patent application Ser. No. 11/742,304 filed on Apr. 30, 2007 and now U.S. Pat. No. 7,475,948. U.S. patent application Ser. No. 11/742,304 is a continuation of U.S. patent application Ser. No. 11/742,261 filed on Apr. 30, 2007 and now U.S. Pat. No. 7,469,971. U.S. patent application Ser. No. 11/742,261 is a continuation-in-part of U.S. patent application Ser. No. 11/464,008 filed on Aug. 11, 2006 and now U.S. Pat. No. 7,338,135. U.S. patent application Ser. No. 11/464,008 is a continuation-in-part of U.S. patent application Ser. No. 11/463,998 filed on Aug. 11, 2006 and now U.S. Pat. No. 7,384,105. U.S. patent application Ser. No. 11/463,998 is a continuation-in-part of U.S. patent application Ser. No. 11/463,990 filed on Aug. 11, 2006 and now U.S. Pat. No. 7,320,505. U.S. patent application Ser. No. 11/463,990 is a continuation-in-part of U.S. patent application Ser. No. 11/463,975 filed on Aug. 11, 2006 and now U.S. Pat. No. 7,445,294. U.S. patent application Ser. No. 11/463,975 is a continuation-in-part of U.S. patent application Ser. No. 11/463,962 filed on Aug. 11, 2006 and now U.S. Pat. No. 7,413,256. The present application is also a continuation-in-part of U.S. patent application Ser. No. 11/695,672 filed on Apr. 3, 2007 and now U.S. Pat. No. 7,396,086. U.S. patent application Ser. No. 11/695,672 is a continuation-in-part of U.S. patent application Ser. No. 11/686,831 filed on Mar. 15, 2007 and now U.S. Pat. No. 7,568,770. All of these applications are herein incorporated by reference for all that they contain.

BACKGROUND OF THE INVENTION

The present invention relates to an improved cutting element or attack tool that may be used to break minerals or rocks or any hard materials in a variety of industries such as mining, drilling, asphalt, construction and excavation industries. Continuous use of a tool may result in wear and tear of the tool. Examples of high-impact resistant tools from the prior art are disclosed in U.S. Pat. No. 6,824,225 to Stiffler, US Pub. No. 20050173966 to Mouthaan and which is now U.S. Pat. No. 6,962,395, U.S. Pat. No. 6,692,083 to Latham, U.S. Pat. No. 6,786,557 to Montgomery, Jr., U.S. Pat. No. 3,830,321 to McKenry et al., U.S. Patent Application Publication No. 2003/0230926 to Mondy, U.S. Pat. No. 4,932,723 to Mills, U.S. Pat. No. 6,702,393 to Merceir, U.S. Pat. No. 6,854,810 to Montgomery, Jr., U.S. Pat. No. 6,851,758 to Beach, which are all herein incorporated by reference for all they contain.

U.S. Pat. No. 3,830,321 to McKenry et al., discloses an excavating tool and a bit for use therewith in which the bit is of small dimensions and is mounted in a block in which the bit is rotatable and which block is configured in such a manner that it can be welded to various types of holders so that a plurality of blocks and bits mounted on a holder make an excavating tool of selected style and size.

U.S. Pat. No. 6,733,087 to Hall, et al., which is herein incorporated by reference for all that it contains, discloses an attack tool for working natural and man-made materials. The attack tool is made up of one or more segments, including a steel alloy base segment, an intermediate carbide wear protector segment, and a penetrator segment comprising a carbide substrate that is coated with a superhard material.

The segments are joined at continuously curved surfaces that vary from one another at about their apex in order to accommodate ease of manufacturing and to concentrate the bonding material in the region of greatest variance. The carbide used for the penetrator and the wear protector may have a cobalt binder or it may be binderless. It may also be produced by the rapid, omnidirectional compaction method as a means of controlling grain growth of the fine cobalt particles. The parts are brazed together in such a manner that the grain size of the carbide is not substantially altered. The superhard coating may consist of diamond, polycrystalline diamond, cubic boron nitride, binderless carbide, or combinations thereof.

BRIEF SUMMARY OF THE INVENTION

A high-impact resistant tool comprises a steel shank. The steel shank has a hollow portion. The shank is adapted for insertion into a holder and connection to a driving mechanism. A carbide cap is joined at a brazed joint to the first end of the shank. In some embodiments, an impact tip may be disposed opposite a cavity in a base end of the cap.

A ceiling of the cavity may comprise a tapered geometry. The tool may be incorporated into a pavement milling machine, mining machine, trencher, or combinations thereof. The shank, the holder and the cavity of the cap may be substantially coaxial. The impact tip may be bonded to the cap opposite the base end. The tip may comprise a carbide segment bonded to a sintered polycrystalline diamond. The carbide segment of the impact tip may comprise a height of less than 10 mm. The diamond may comprise a substantially conical portion.

The diamond may comprise an axial thickness of at least 0.100 inches thick. The base end of the cap may overhang the first end of the shank. The hollow portion of the shank may contain a lubricant. The lubricant may be adapted to lubricate the outer diameter of the shank and an inner diameter of the holder. The braze joint may be tapered or planar. The cap may be asymmetric. The steel shank may comprise a substantially T-shaped geometry.

The shank may comprise a groove. The base end of the cap may comprise a protrusion adapted to interlock with the groove of the shank. The hollow portion of the shank may extend along an entire length of the shank from the first end to a second end. At least a portion of the cap may protrude into the hollow portion through the first end of the shank.

DETAILED DESCRIPTION OF THE INVENTION AND THE PREFERRED EMBODIMENT

Figure 1:
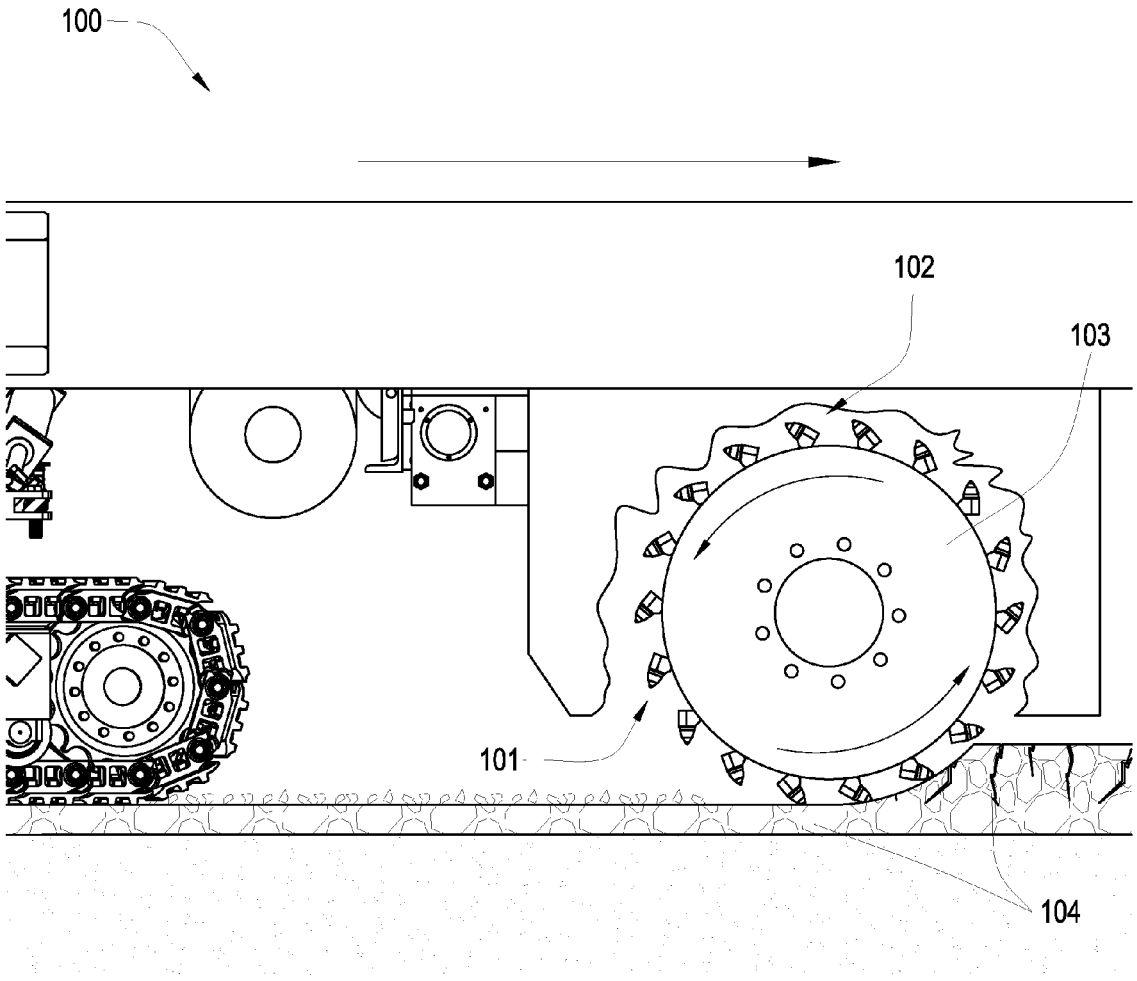
FIG. 1 is a cross-sectional diagram of an embodiment of a plurality of high-impact resistant tools.

FIG. 1 is a cross-sectional diagram of an embodiment of a plurality of a high-impact resistant tools 101 attached to a driving mechanism 103, such as a rotating drum connected to the underside of a pavement milling machine 100. The milling machine 100 may be a cold planer used to degrade man-made formations 104 such as pavement prior to the placement of a new layer of pavement. High-impact resistant tools 101 may be attached to the driving mechanism 103 bringing the high-impact resistant tools 101 into engagement with the formation 104. A holder 102 or block may hold the high-impact resistant tool 101 at an angle offset from the direction of rotation of the drive mechanism 103, such that the high-impact resistant tool 101 engages the formation 104 at a preferential angle.

Figure 2:
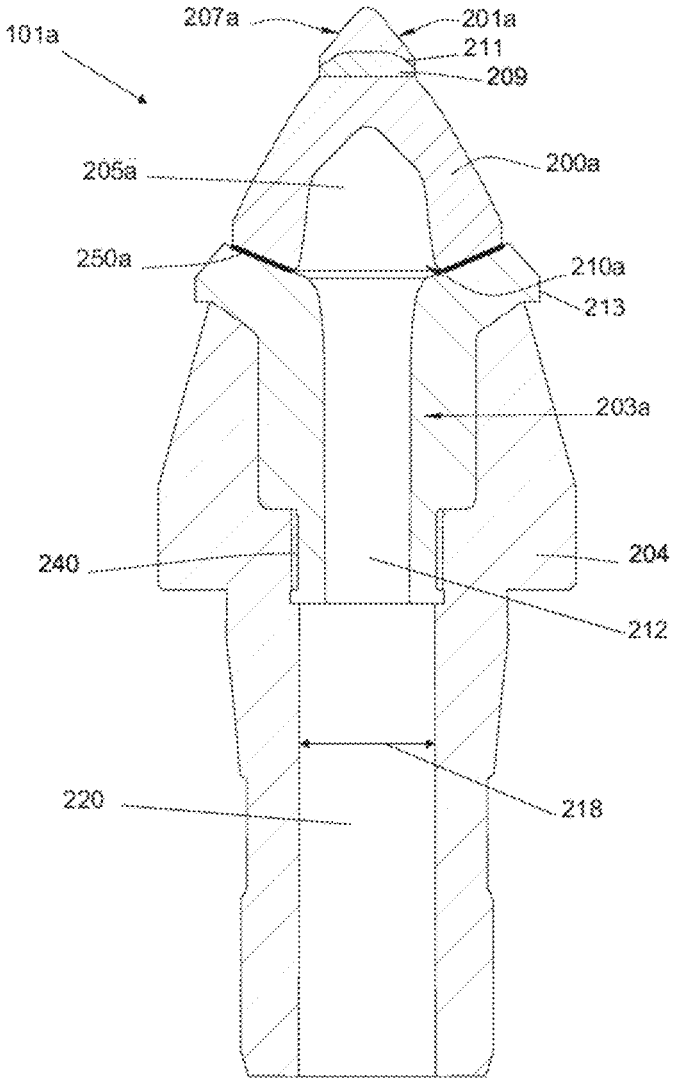
FIG. 2 is cross-sectional diagram of an embodiment of a high-impact resistant tool.

Referring now to FIG. 2, a high-impact resistant tool 101*a* may be designed for high-impact resistance and long life while in operation. The high-impact resistant tool 101*a* comprises a carbide cap 200*a* with an impact tip 201*a*, a hollow shank 203*a* and a holder 204*a* adapted to receive the hollow shank 203*a*. The carbide cap 200*a* may comprise a cavity 205*a* with a tapered geometry. The carbide cap 200*a* and the hollow shank 203*a* may be brazed together at a braze joint 250*a*. The cavity 205*a* and a hollow portion 212 of the hollow shank 203*a* may allow enough space for thermal expansion while brazing the carbide cap 200*a* with a first end 210*a* of the hollow shank 203*a*. The brazed joint 250*a* may be tapered. In some embodiments, brazed joint 250*a* may be brazed along surfaces at different angles. A braze material may comprise copper, brass, lead, tin, silver, or combinations thereof.

The carbide cap 200*a* may comprise tungsten carbide, calcium carbide, silicon carbide, cementite, boron carbide, tantalum carbide, titanium carbide or combinations thereof. The impact tip 201*a* may comprise a super hard material 207*a* bonded to a carbide substrate 209 at a non-planar interface 211.

The super hard material 207 may comprise diamond, polycrystalline diamond with a binder concentration of 1 to 40 weight percent, cubic boron nitride, refractory metal bonded diamond, silicon bonded diamond, layered diamond, infiltrated diamond, thermally stable diamond, natural diamond, vapor deposited diamond, physically deposited diamond, diamond impregnated matrix, diamond impregnated carbide, monolithic diamond, polished diamond, course diamond, fine diamond, nonmetal catalyzed diamond, cemented metal carbide, chromium, titanium, aluminum, tungsten, or combinations thereof.

The hollow shank 203*a* may be press fit into the holder 204. The hollow shank 203*a* may comprise a snap mechanism 240 adapted to hold the hollow shank 203*a* and the holder 204 together. The largest diameter 213 of the hollow shank 203*a* may overhang a portion of the outer diameter of the holder 204.

The high-impact resistant tool 101*a* may be lubricated. The lubricant may be provided from the driving mechanism 103 of FIG. 1. In embodiments such as FIG. 1., where the driving mechanism 103 is a drum, the drum may comprise a lubricant reservoir and a port may be formed in the drum which connects the lubricant reservoir to the hollow portion 212 of the hollow shank 203*a*. The lubricant reservoir may be pressurized to force the lubricant between the outer diameter of the hollow shank 203*a* and an inner diameter 218 of a bore 220 inner diameter of the holder 204.

A weeping seal may provide the benefit of preventing the debris from entering between the hollow shank 203*a* and the inner diameter 218 of the bore 220 of the holder 204, while allowing some lubricant to escape to keep the seal clean.

Figure 3:
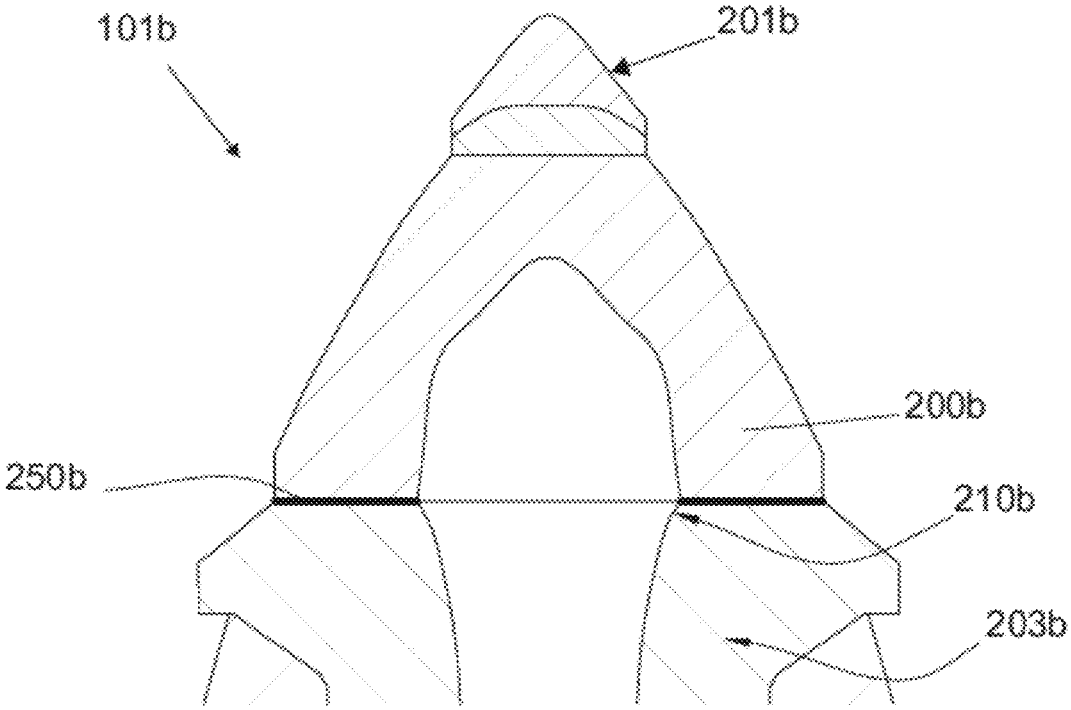
FIG. 3 is cross-sectional diagram of another embodiment of a high-impact resistant tool.

In FIG. 3, a cross-sectional diagram of another embodiment of a high-impact resistant tool 101*b* is disclosed. A carbide cap 200*b* and a first end 210*b* of a hollow shank 303 may be brazed together at a braze joint 250*b* having a planar interface. Braze material may comprise a melting temperature from 700 to 1200 degrees Celsius; preferably the melting temperature is from 800 to 970 degrees Celsius. The heat for brazing may be typically provided by a hand-held torch, a furnace or an induction heating system. Preferably, an impact tip 201*b* is brazed to the carbide cap 200*b* at the same time that the carbide cap 200*b* is brazed to the hollow shank 203*b*.

Figure 4:
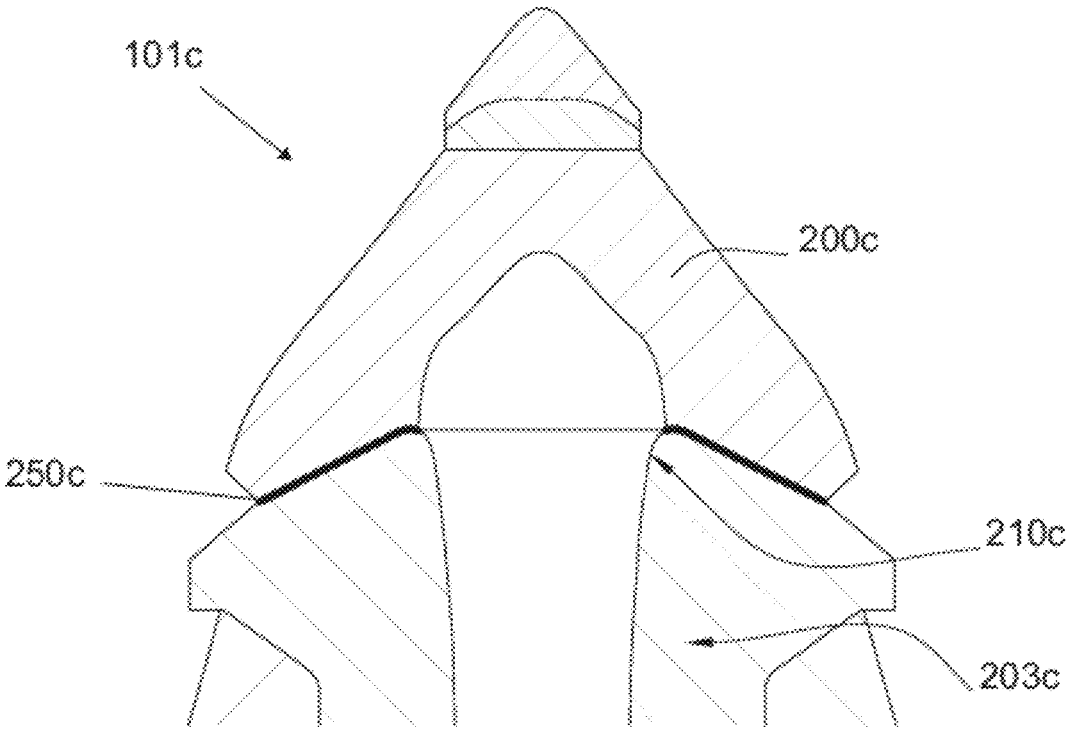
FIG. 4 is cross-sectional diagram of another embodiment of a high-impact resistant tool.

FIG. 4 is a cross-sectional diagram of another embodiment of a high-impact resistant tool 101*c*. A carbide cap 200*c* and a first end 210*c* of a hollow shank 203*c* may be brazed at a braze joint 250*c* having a tapered interface.

Figure 5:
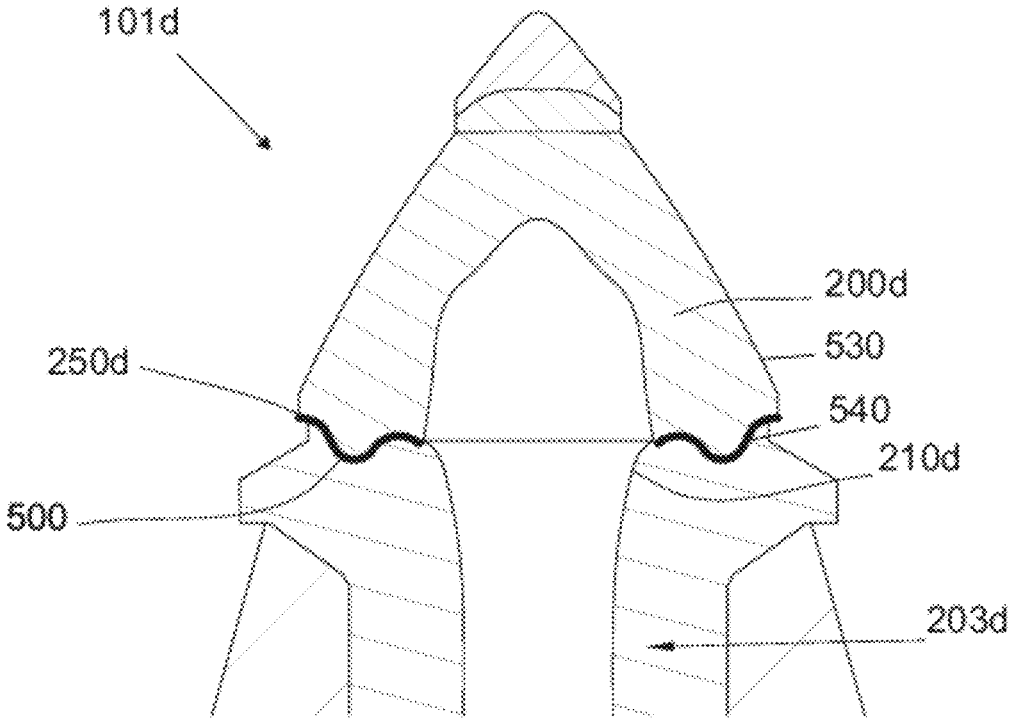
FIG. 5 is cross-sectional diagram of another embodiment of a high-impact resistant tool.

FIG. 5 is a cross-sectional diagram of another embodiment of a high-impact resistant tool 101*d*. A carbide cap 200*d* and a first end 210*d* of a hollow shank 203*d* may be brazed together at a braze joint 250*d* having a non-planar interface. A base end 530 of the carbide cap 200*d* may comprise a protrusion 500 adapted to be received within a recess 540 of the first end 210*d* of the hollow shank 203*d*. The geometry of the brazed joint 250*d* may allow more surface area for brazing. The brazed joint 250*d* may also interlock the base end 530 of the carbide cap 200*d* and the first end 210*d* of the hollow shank 203*d* when brazed together.

Figure 6:
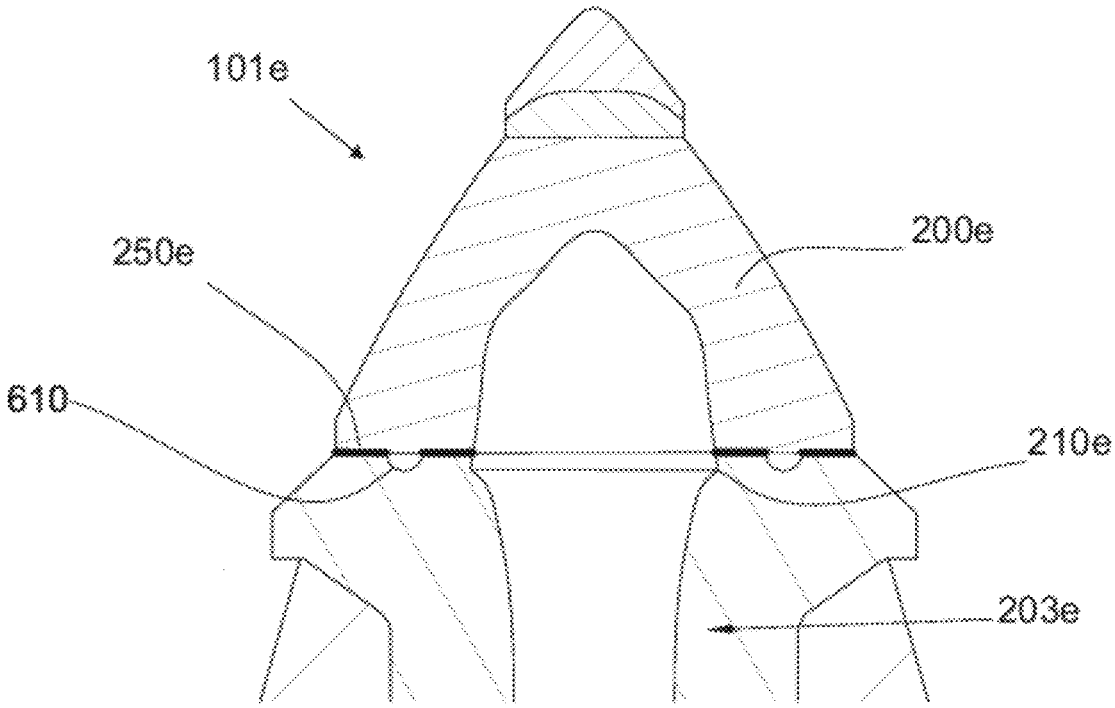
FIG. 6 is cross-sectional diagram of another embodiment of a high-impact resistant tool.

FIG. 6 is a cross-sectional diagram of another embodiment of high-impact resistant tool 101*e*. A carbide cap 200*e* may be brazed with a first end 210*e* of a hollow shank 203*e* at a braze joint 250*e* having a planar interface. The first end 210*e* of the hollow shank 203*e* may comprise a groove 610 to allow for thermal expansion while brazing.

Figure 7:
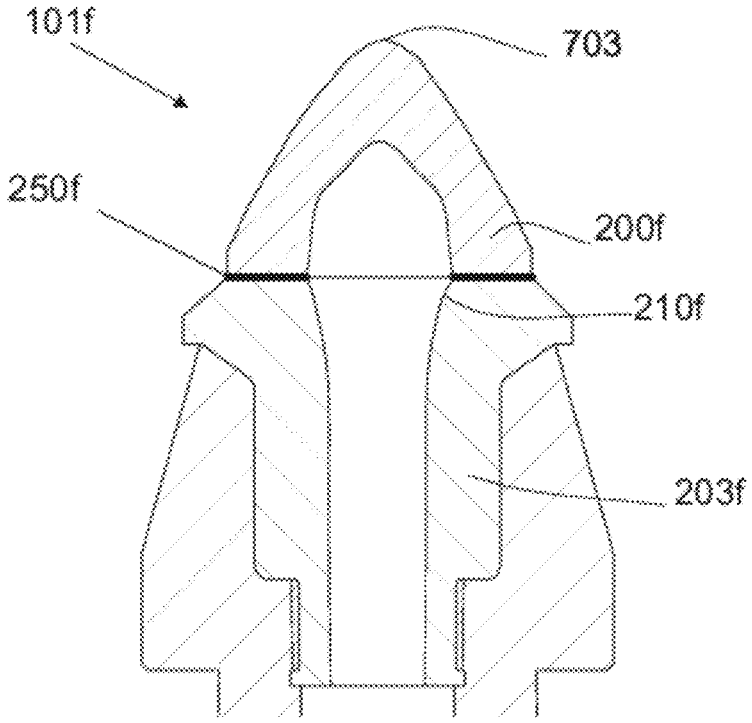
FIG. 7 is cross-sectional diagram of another embodiment of a high-impact resistant tool.

FIG. 7 discloses a cross-sectional diagram of another embodiment of high-impact resistant tool 101*f*. A carbide cap 200*f* and a first end 210*f* of a hollow shank 203*f* are brazed together at braze joint 250*f* having a planar interface. The carbide cap 200*f* may comprise a carbide tip 703.

Figure 8:
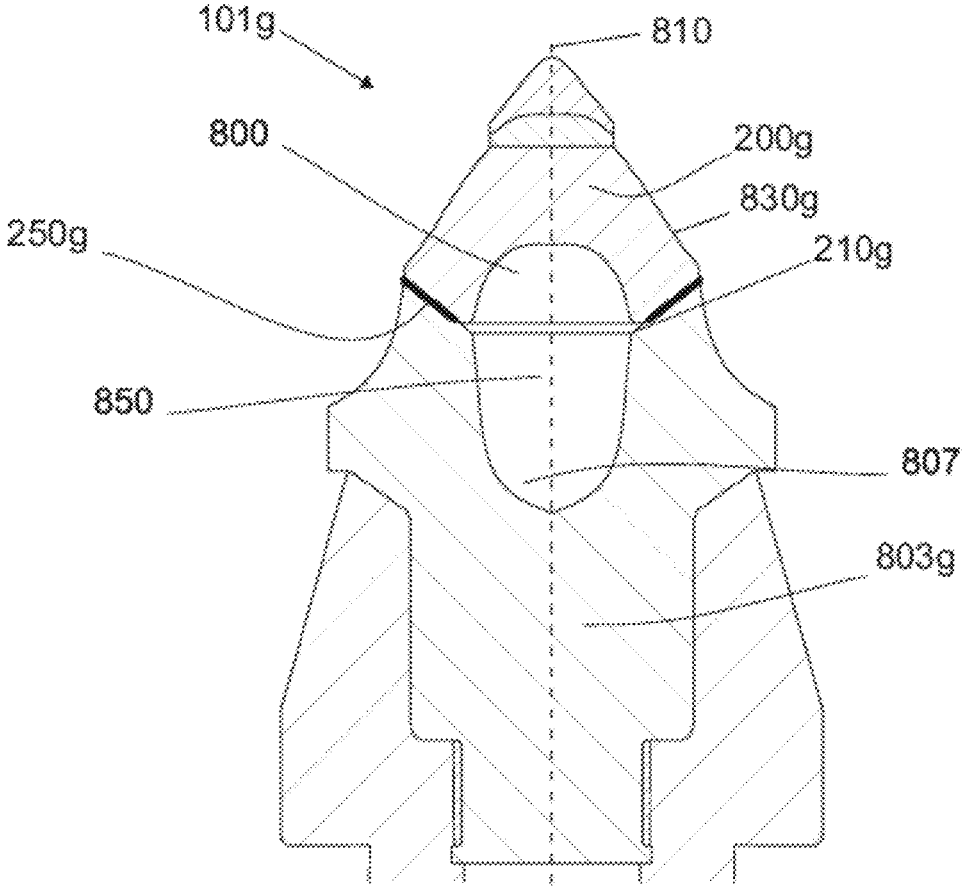
FIG. 8 is cross-sectional diagram of another embodiment of a high-impact resistant tool.

FIG. 8 discloses a cross-sectional diagram of another embodiment of high-impact resistant tool 101*g*. A carbide cap 200*g* may be brazed to a first end 210*g* of a solid shank 803 at a braze joint 250*g* having a tapered interface. The brazed joint 250*g* may comprise a positive slope or a negative slope relative to a central axis 810. A base end 830*g* of the carbide cap 200*g* may comprise a cavity 800 with a tapered geometry. The solid shank 803 may have a cavity 807 formed in a first end 210*g*. The high-impact resistant tool 101*g* may form a single cavity 850 when the carbide cap 200*g* and the first end 210*g* of the solid shank 803 are brought together by brazing. The single cavity 809 may allow space for thermal expansion while brazing.

Figure 8A:
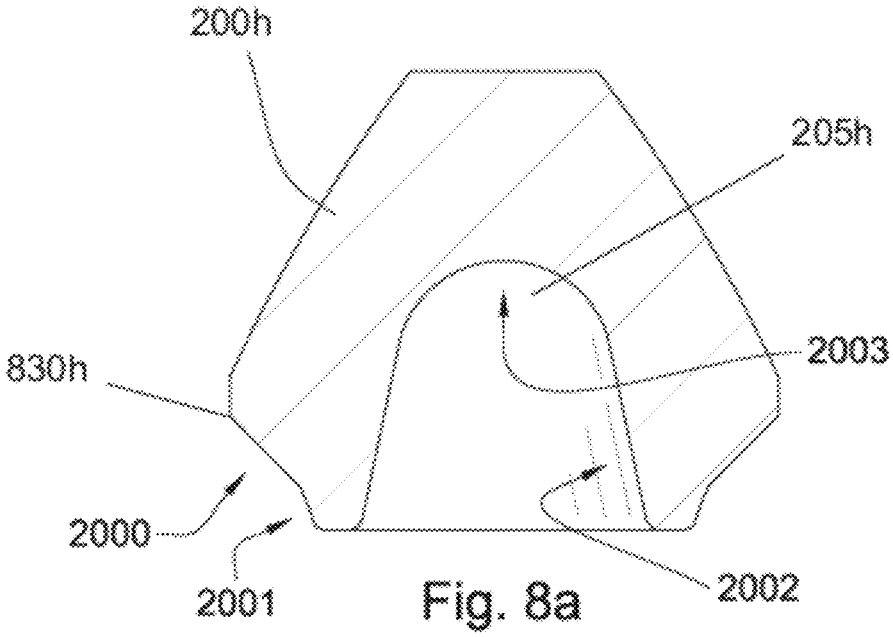
FIG. 8*a* is cross-sectional diagram of another embodiment of a cap.

FIG. 8*a* is a cross sectional diagram of another embodiment of a carbide cap 200*h* including multiple tapers 2000, 2001 proximate a base end 830*h* of the carbide cap 200*h* adapted to be brazed to a solid shank, such as solid shank 803 illustrated in FIG. 8. A cavity 205*h* includes a cavity wall 2002. The cavity wall 2002 comprises a taper generally increasing as it approaches a base end 830*h* of the carbide cap 200*h*. A ceiling 2003 of the carbide cap 200*h* is generally rounded and may form an inverted spherical section, inverted centenary geometry, inverted ellipsoid, section, a parabola, or combinations thereof.

Figure 9:
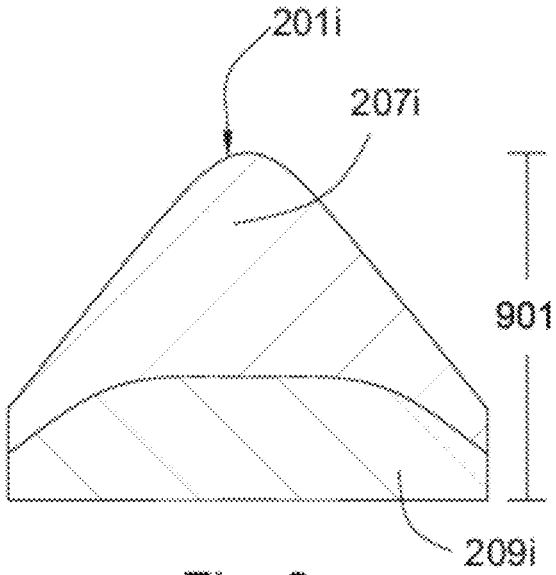
FIG. 9 is cross-sectional diagram of an embodiment of an impact tip.

FIG. 9 is a cross-sectional diagram of an embodiment of an impact tip 201*i* of a high-impact resistant tool, such as the high-impact resistant tool 101 illustrated in FIG. 1. The impact tip 201*i* may comprise a diamond tip 207*i* with a carbide substrate 209*i*. The impact tip 201*i* may possess a generally conical shape. The diamond tip 207*i* may be two-thirds of a height 901 of the impact tip 201*i*. The impact tip 201*i* may be incorporated into tools 101*a* through 101*g*.

Figure 10:
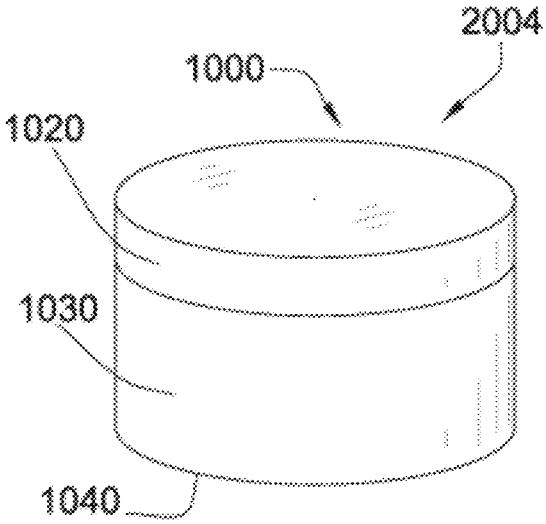
FIG. 10 is a perspective diagram of another embodiment of an impact tip.

FIG. 10 is a perspective diagram of another embodiment of an impact tip 1000 of a high-impact resistant tool, such as the high-impact resistant tool 101 illustrated in FIG. 1. The impact tip 1000 may comprise a diamond tip 1020 with a carbide substrate 1030. The impact tip 1000 may possess a circular base 1040. This impact tip may be well suited for applications where an edge 2004 impacts and cuts into a formation.

Figure 11A:
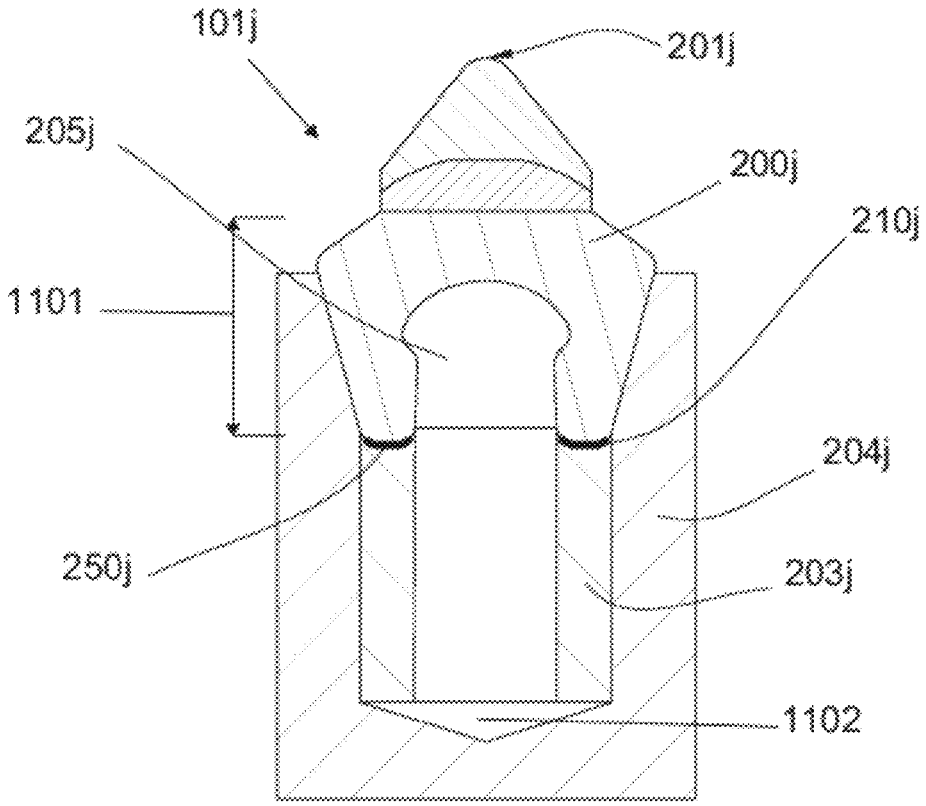
FIG. 11*a* is cross-sectional diagram of an embodiment of a high-impact resistant tool

FIG. 11*a* is a cross-sectional diagram of an embodiment of a high-impact resistant tool 101*j*. The high-impact resistant tool 101*j* may comprise a carbide cap 200*j* with an impact tip 201*j*, the carbide cap 200*j* brazed with a first end 210*j* of a hollow shank 203*j*. The carbide cap 200*j* may comprise a cavity 205*j* aligned with the hollow shank 203*j*. More than two-thirds of a height 1101 of the carbide cap 200*j* may be embedded inside a bore 1102 of a holder 204*j*. In this embodiment, the hollow shank 203*j* may be press fit or anchored into the bore 1002 of the holder 204*j*.

The holder 1104*j* or a block coupled to the holder 1104*j* may be coupled to a driving mechanism for the tool 101*j*, such as the driving mechanism 103 of FIG. 1. The driving mechanism may be incorporated into a milling or mining drum. In other embodiments, the driving mechanism may be incorporated into a drill bit, percussion bit, roof bolt bit, roller cone bit, dredge, tunneling machine, trencher or combinations thereof.

Figure 11B:
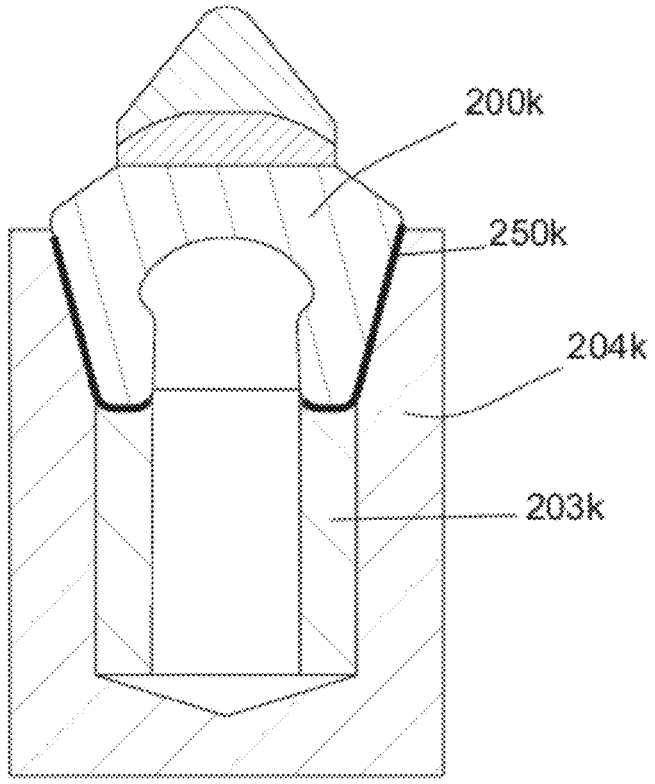
FIG. 11*b* is cross-sectional diagram of an embodiment of a high-impact resistant tool.

FIG. 11*b* discloses another embodiment with the carbide cap 200*k* also being brazed to the holder 204*k*, in addition to, a hollow shank 203*k* at a braze joint 250*k*.

Figure 12:
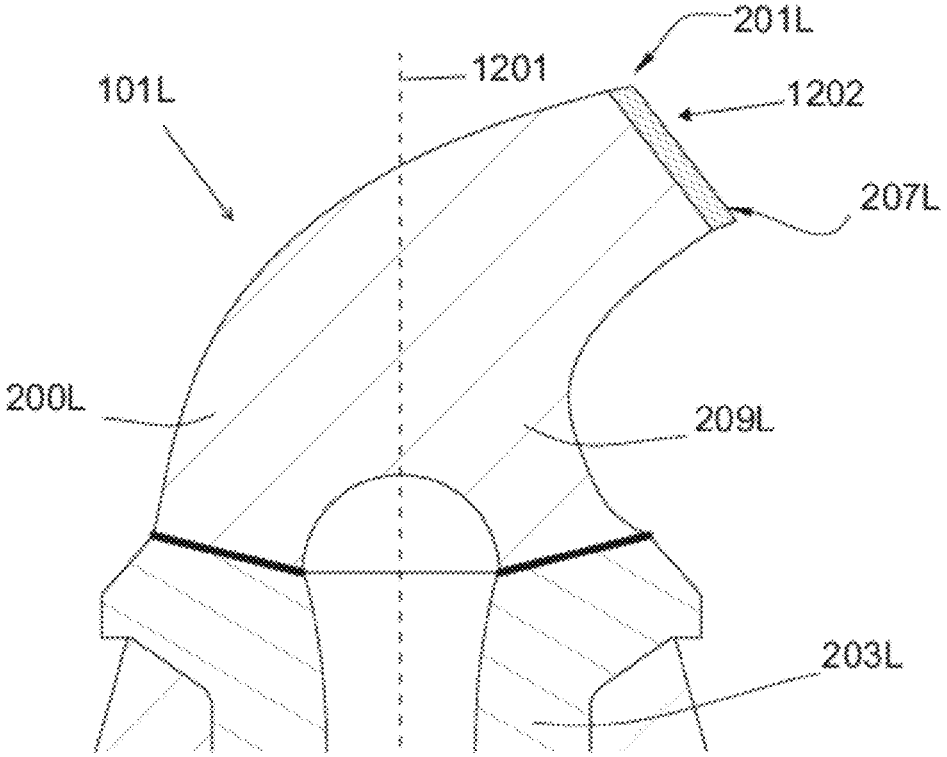
FIG. 12 is cross-sectional diagram of another embodiment of a high-impact resistant tool.

FIG. 12 is a cross-sectional diagram of another embodiment of a high-impact resistant tool 101L. The high-impact resistant tool 101L may comprise a carbide cap 200L with an impact tip 201L, the carbide cap 200L brazed with a hollow shank 203L. The impact tip 201L may comprise a diamond tip 207L and a carbide substrate 209L. The carbide cap 200L may be asymmetric with respect to an axis 1201 and may have an impact tip 201L with a generally flat portion 1202.

Figure 13:
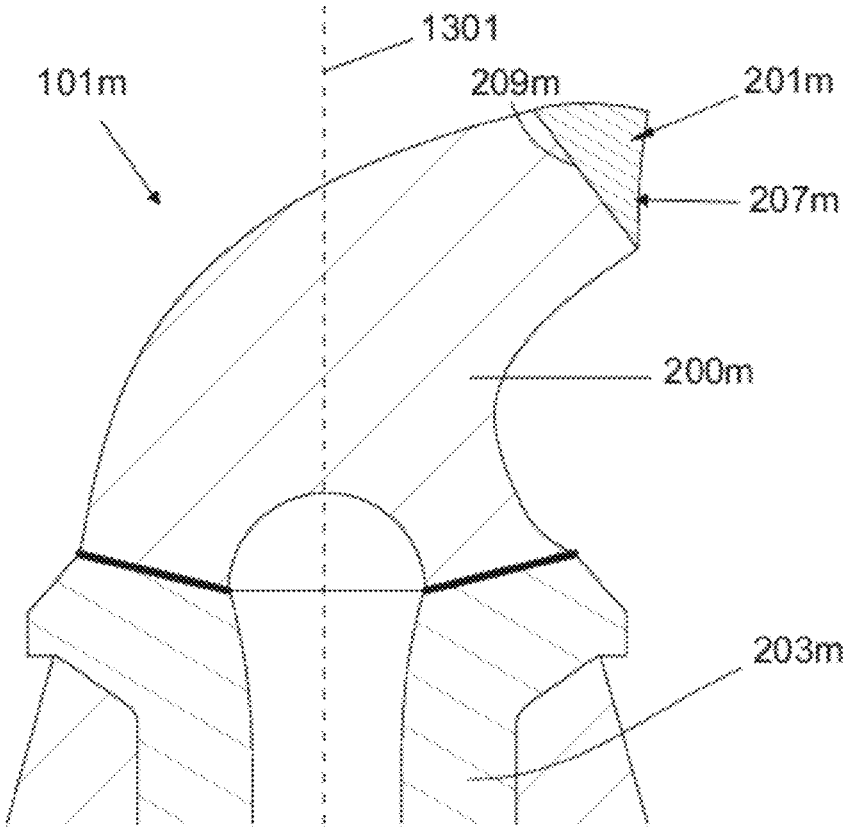
FIG. 13 is cross-sectional diagram of another embodiment of a high-impact resistant tool.

FIG. 13 illustrates another embodiment of a high-impact resistant tool 101*m* similar to the embodiment of FIG. 12. The high-impact resistant tool 101*m* may include a carbide cap 200*m* with an impact tip 201*m*, the carbide cap 200*m* brazed with a hollow shank 203*m*. The impact tip 201*m* may be a diamond tip 207*m* and a carbide substrate 209*m*. The carbide cap 200*m* may be asymmetric with respect to an axis 1301 and may include a generally pointed impact tip 201*m*.

Figures 13A, 13B, 13C:
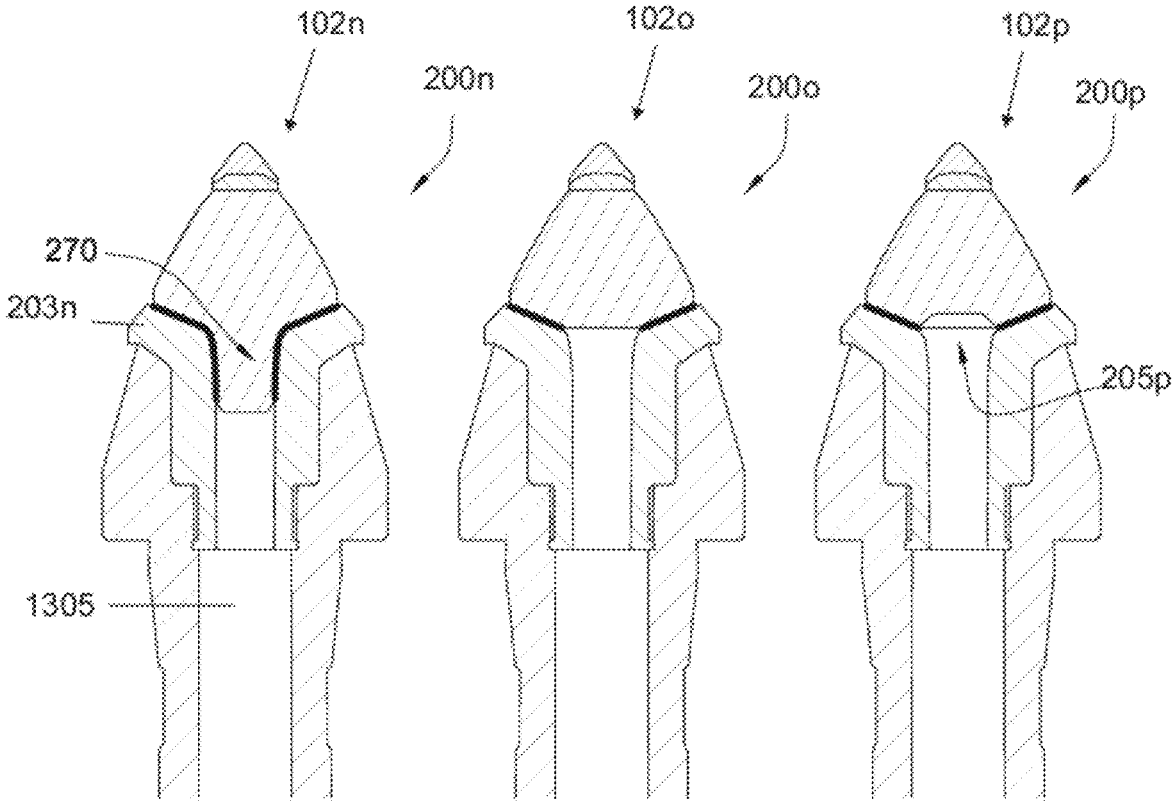
FIG. 13*a* is cross-sectional diagram of another embodiment of a high-impact resistant tool.
FIG. 13*b* is cross-sectional diagram of another embodiment of a high-impact resistant tool.
FIG. 13*c* is cross-sectional diagram of another embodiment of a high-impact resistant tool.

FIG. 13*a* discloses an embodiment of an high-impact resistant tool 101*n* that includes a carbide cap 200*n* with a stem 270 that extends into a hollow portion 1305 of the steel shank 203*n*.

FIG. 13*b* discloses another embodiment of an high-impact resistant tool 101*o* that includes a carbide cap 200*o* without a cavity.

FIG. 13*c* discloses another embodiment of an high-impact resistant tool 101*p* that includes a carbide cap 200*p* with a small cavity 205*p*.

Figure 14:
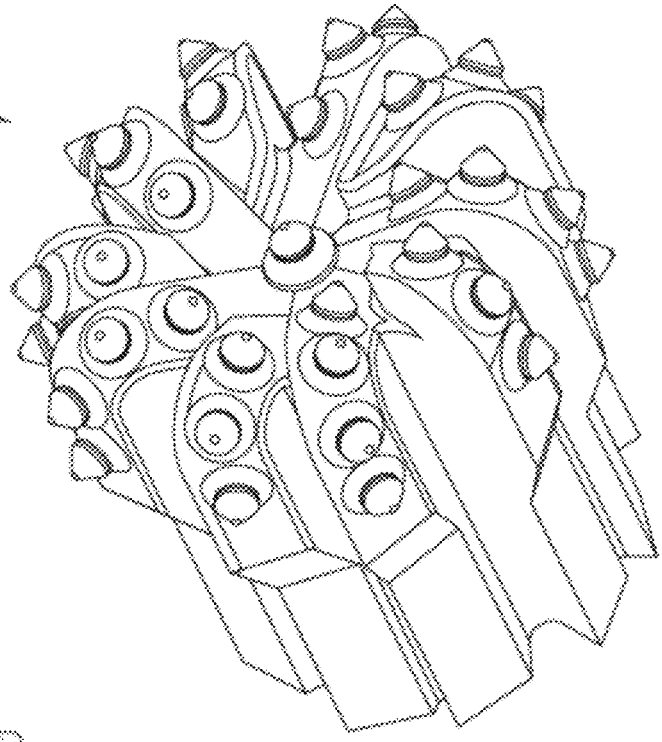
FIG. 14 is perspective diagram of an embodiment of a rotary drag drill bit.

FIGS. 14-17 disclose bits that may be compatible with the present invention. FIG. 14 is a perspective diagram of an embodiment of a degradation assembly 2050, such as rotary drag drill bit used for drilling holes and breaking hard rocks.

Figure 15:
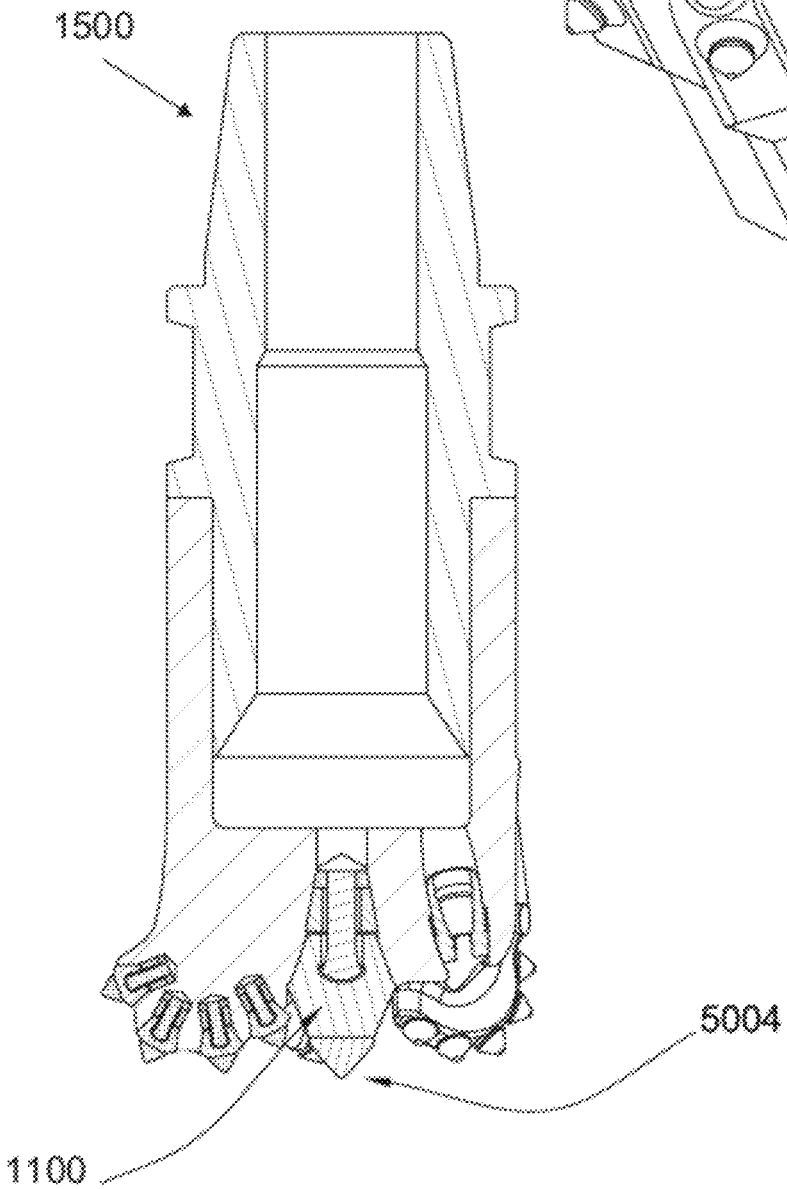
FIG. 15 is cross-sectional diagram of another embodiment of a rotary drag drill bit.

FIG. 15 shows a cross-sectional diagram of another embodiment of a degradation assembly 1500 such as a rotary drag bit that includes an assembly 1100 protruding beyond a face 5004 of the drill bit.

Figure 16:
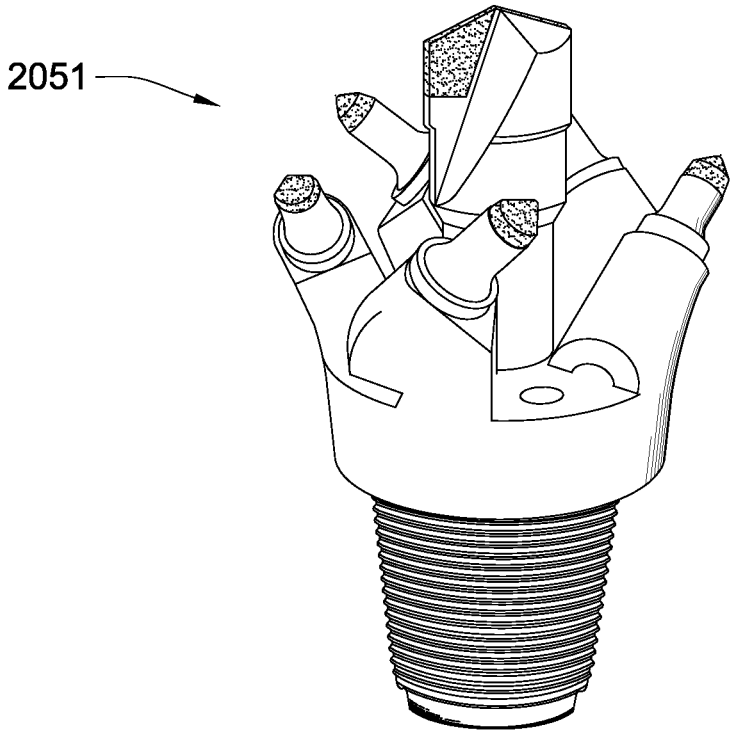
FIG. 16 is a perspective diagram of an embodiment of a downhole rotary drag drill bit.

FIG. 16 discloses a degradation assembly 2051 such as a type of drill bit adapted for drilling water wells.

Figure 17:
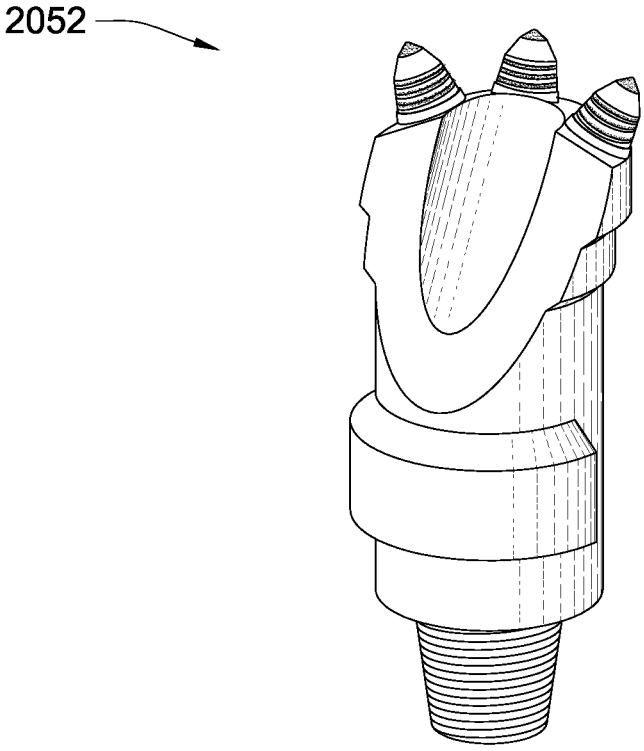
FIG. 17 is a perspective diagram of an embodiment of a horizontal directional drill bit.

FIG. 17 discloses a degradation assembly 2052 such as a bit adapted for drilling horizontal wells.

Figure 18:
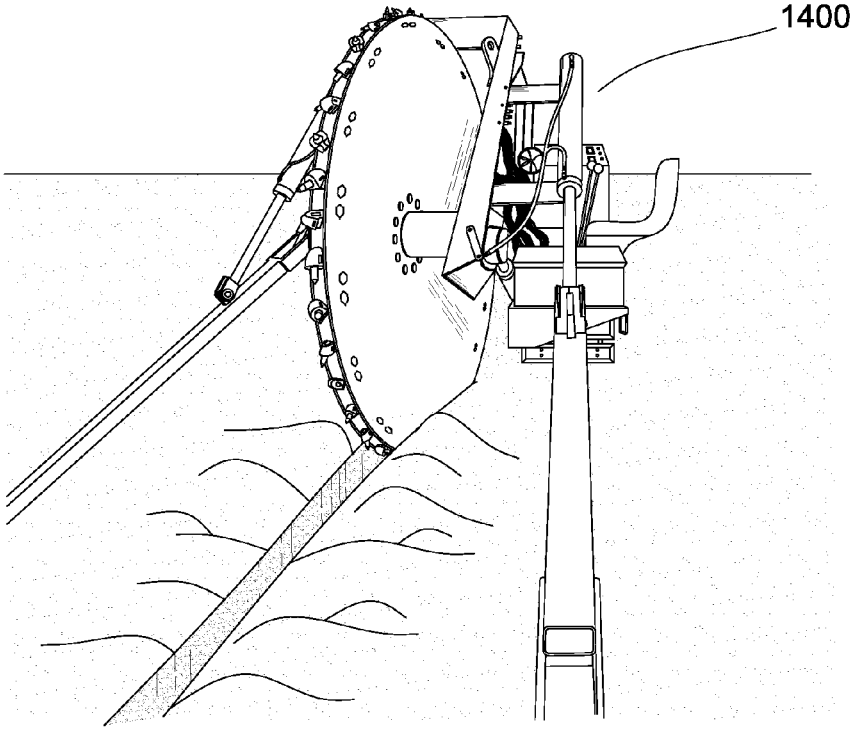
FIG. 18 is perspective diagram of an embodiment of a trenching machine.
Figure 19:
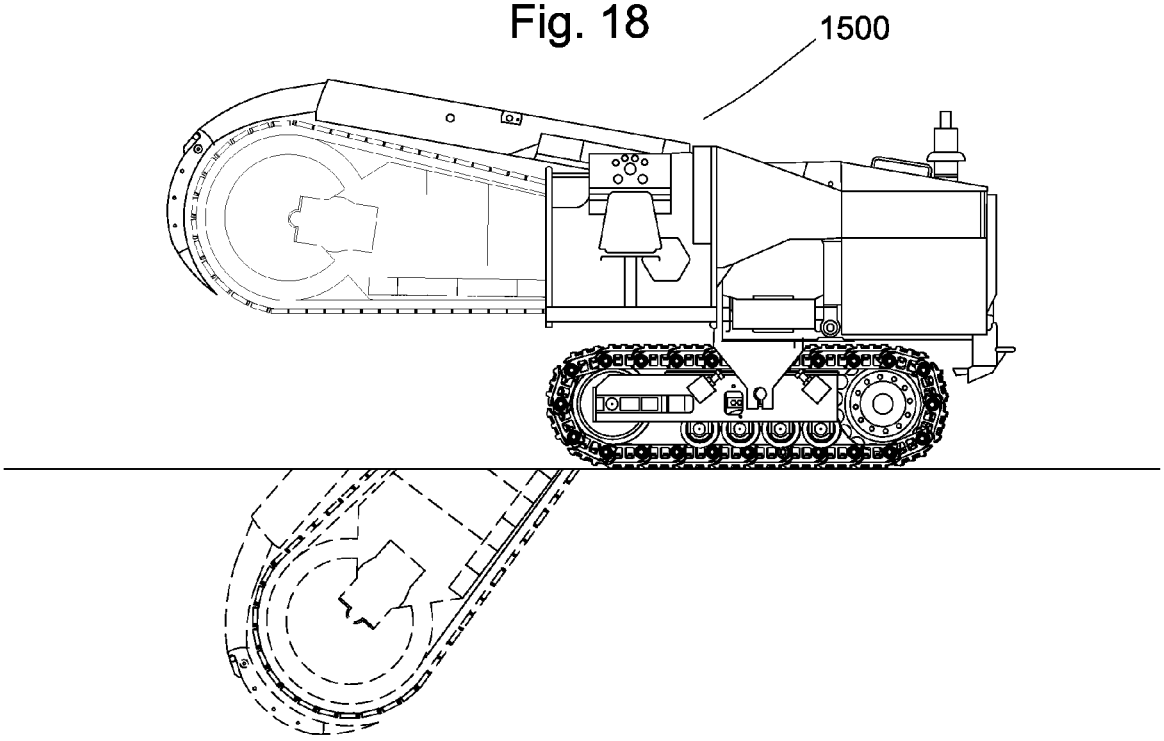
FIG. 19 is perspective diagram of another embodiment of a trenching machine.

FIGS. 18 and 19 disclose embodiments for trenching machines that may also be compatible with the present invention. FIG. 18 discloses a wheel trencher 1400 while FIG. 19 discloses a chain trencher 1500.

Figure 20:
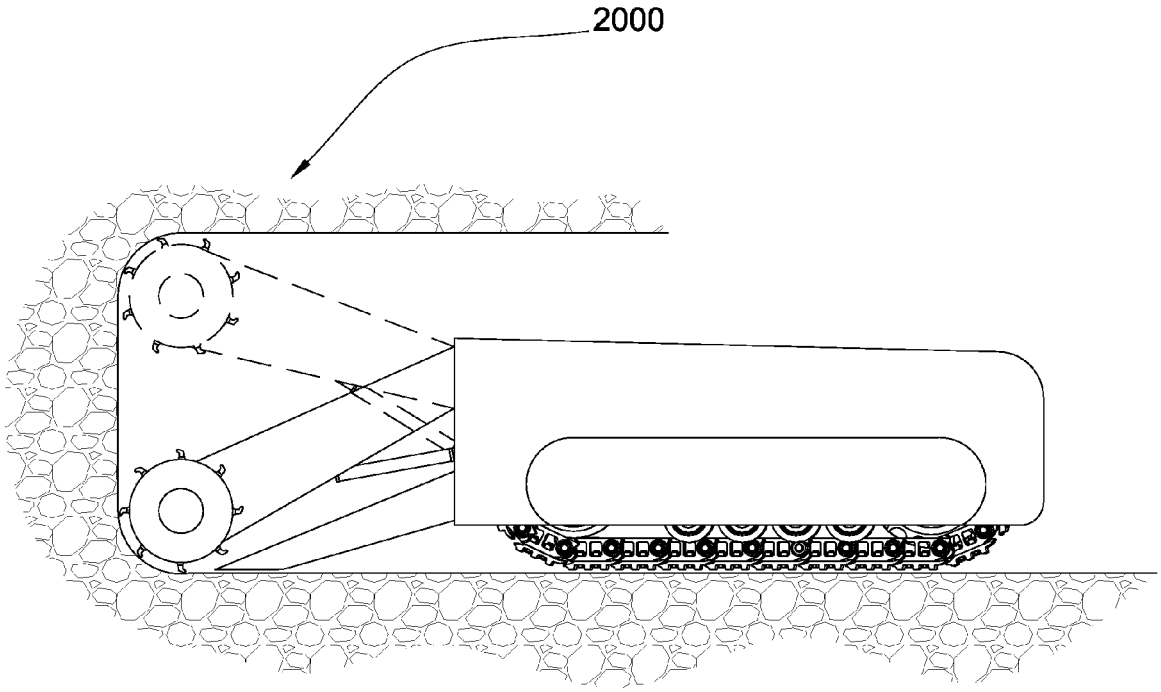
FIG. 20 is an orthogonal diagram of an embodiment of a mining machine.

FIG. 20 is an orthogonal diagram of an embodiment of a mining machine 2000 which may also incorporate the present invention Whereas the present invention has been described in particular relation to the drawings attached hereto, it should be understood that other and further modifications apart from those shown or suggested herein, may be made within the scope and spirit of the present invention.

What is claimed is:

1. A high-impact resistant tool for attachment to a driving mechanism, the high-impact resistant tool comprising:

a holder having a bore;

a steel shank having a first end, a second end, and a hollow portion between the first end and the second end, the second end being adapted for insertion into the bore;

a cap having a base end, the base end having a cavity disposed therein and the cap being attached to the first end by brazing at a braze joint; and an impact tip including a super-hard material bonded to a carbide substrate segment, the carbide substrate being joined to the carbide cap opposite the base end.

2. The high-impact resistant tool of claim 1, wherein the cavity includes a ceiling and wherein the ceiling of the cavity has a tapered geometry.

3. The high-impact resistant tool of claim 1, wherein the high-impact resistant tool is incorporated into an item of the group consisting of pavement milling machine, mining machine, and trencher.

4. The high-impact resistant tool of claim 1, wherein the steel shank, the holder, and the cavity of the cap each have a central axis which are all substantially coaxial.

5. The high-impact resistant tool of claim 1, wherein the super hard material is a polycrystalline diamond.

6. The high-impact resistant tool of claim 1, wherein the super hard material is substantially conical.

7. The high-impact resistant tool of claim 1, wherein the base end of the cap overhangs the first end of the steel shank.

8. The high-impact resistant tool of claim 1, wherein the hollow portion of the steel shank contains a lubricant, and wherein the hollow portion of the steel shank is adapted to supply the lubricant between an outer diameter of the steel shank and an inner diameter of the bore of the holder.

9. The high-impact resistant tool of claim 1, wherein the braze joint is tapered.

10. The high-impact resistant tool of claim 1, wherein the braze joint is planar.

11. The high-impact resistant tool of claim 1, wherein the steel shank includes a groove on the first end to allow for thermal expansion of the first end.

12. The high-impact resistant tool of claim 11, wherein the base end of the cap comprises a protrusion adapted to extend into the groove on the first end of the steel shank.

13. The high-impact resistant tool of claim 1, wherein the hollow portion of the steel shank extends through an entire length of the steel shank from the first end to the second end.

14. The high-impact resistant tool of claim 1, wherein at least a portion of the cap protrudes into the hollow portion of the steel shank through the first end of the steel shank.

15. The high-impact resistant tool of claim 1, further comprising a central axis, wherein the cap is asymmetric about the central axis.

16. The high-impact resistant tool of claim 1, wherein the cavity of the carbide cap aligns with the hollow portion of the steel shank to form a single, enveloped cavity.

17. The high-impact resistant tool of claim 1 wherein the super hard material of the impact tip has a height of at least two-thirds of a height of the impact tip.

18. The high-impact resistant tool of claim 17, wherein the carbide of the impact tip comprises a height of less than 9 mm.

19. The high-impact resistant tool of claim 17, wherein the super hard material comprises an axial thickness at least 0.100 inches thick.

20. A high-impact resistant tool for attachment to a driving mechanism, comprising:

a holder including a bore adapted to receive a shank;

a shank including a first end, a second end opposite the first end, and a bore extending from the first end to the second end, the second end of the steel shank being adapted for insertion into the bore of the holder;

a cap having a base end, the base end including a cavity formed therein, the cavity including a ceiling, and the base end joined to the first end of the shank; and an impact tip having a super hard material bonded to a carbide substrate, the carbide substrate being joined to the carbide cap opposite the base end.

* * * * *